US007686130B1

(12) United States Patent
Quaglia

(10) Patent No.: US 7,686,130 B1
(45) Date of Patent: Mar. 30, 2010

(54) DUAL MODE VEHICLE EXHAUST SYSTEM AND ASSOCIATED METHOD

(76) Inventor: Fernando Quaglia, 1384 N. Chaffy Ct., Ontario, CA (US) 91762

( * ) Notice: Subject to any disclaimer, the term of this patent is extended or adjusted under 35 U.S.C. 154(b) by 223 days.

(21) Appl. No.: 11/894,474

(22) Filed: Aug. 21, 2007

Related U.S. Application Data

(60) Provisional application No. 60/823,019, filed on Aug. 21, 2006.

(51) Int. Cl.
*F01N 1/18* (2006.01)

(52) U.S. Cl. ..... 181/226; 181/241; 181/254; 180/309

(58) Field of Classification Search ..... 181/226, 181/238, 239, 241, 253, 254; 180/309
See application file for complete search history.

(56) References Cited

U.S. PATENT DOCUMENTS 4,342,194 A * 8/1982 Paddock et al. ..... 60/290
5,388,408 A * 2/1995 Lawrence ..... 60/324
6,591,935 B1 * 7/2003 Petley ..... 180/309
6,640,927 B1 * 11/2003 Turner ..... 181/252
6,662,554 B2 * 12/2003 Sheidler et al. ..... 60/290
2002/0175022 A1 * 11/2002 Schumacher et al. ..... 181/254
2004/0006970 A1 * 1/2004 Worner et al. ..... 60/272

* cited by examiner

*Primary Examiner*—Jeffrey Donels
*Assistant Examiner*—Jeremy Luks

(57) ABSTRACT

A dual-mode exhaust system includes a housing with an input port attached to the existing muffler exhaust system and positioned downstream thereof. The system further includes a mechanism for selectively distributing vehicle exhaust from the input port to the first and second output ports, upper and lower chambers vertically stacked within the housing, and first and second vertically spaced pendulum arms disposed within the upper and lower chambers respectively and anchored at respective distal ends thereof respectively. First and second vehicle exhaust pipes are coupled to the first and second output ports.

15 Claims, 4 Drawing Sheets

DUAL MODE VEHICLE EXHAUST SYSTEM AND ASSOCIATED METHOD

CROSS REFERENCE TO RELATED APPLICATIONS

This application claims the benefit of U.S. Provisional Application No. 60/823,019, filed Aug. 21, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to exhaust systems and, more particularly, to a dual mode vehicle exhaust system for allowing a user to generate a desired audible sound from an existing muffler exhaust system of the vehicle.

2. Prior Art

There was a time when America's auto makers competed to offer consumers the biggest tail fins, the most powerful engines, the latest in bucket seats and vinyl roofs. Many car models, referred to as muscle cars, produced a distinctive engine sound that conveyed a sense of power waiting to be unleashed. Today, however, emphasis is placed on producing fuel efficient, quieter cars that make very little engine noise. Many motorists, however, especially car aficionados, regardless of what kind of car they buy, want a car that communicates a distinguishing sound of controlled power, like a finely-tuned instrument. Obviously, it would be advantageous to provide a means for allowing motorists to select an exhaust pipe that produces a quiet, muffled sound or a distinctive and powerful sound.

U.S. Pat. No. 4,342,194 to Paddock discloses an electric air control switching valve for use in controlling the delivery of secondary air from an engine driven air pump selectively. The valve functions with both engine operation and the operation of its associated emission control system, with either the exhaust manifold of an engine, preferably at a location closely adjacent to the exhaust ports of the engine. The valve further functions during low temperature engine operation, to the atmosphere, as at the dirty side of the air cleaner associated with the induction system of the engine. During low temperature engine deceleration, to a converter in the exhaust system for the engine downstream of the exhaust manifold during normal engine operation, or again to the atmosphere, as at the dirty side of the air cleaner, when the converter temperature exceeds a predetermined temperature. Unfortunately, this prior art example does not enable a user to determine what type of sound is emitted from a vehicle exhaust system.

U.S. Pat. No. 5,388,408 to Lawrence discloses an exhaust system for vehicles and other devices with internal combustion engines such as boats, airplanes, lawnmowers, tractors, and the like. The system includes a sound attenuating chamber with a single, common opening in an imperforate container providing access for exhaust gases both to and from the container while attenuating the exhaust sound thereof. The system maintains low back pressure during operation. Resonator tubes and optional sound absorbing material may be used in the chamber to control exhaust sounds. An optional, remote-operated, sound control valve upstream of the chamber allows individualized control of the exhaust sound by the vehicle driver. An optional baffle in the exhaust outlet and/or an optional helical insert in the exhaust pipe further deadens the sound. In a preferred form, the system is attached downstream of a catalytic converter and includes dual sound attenuating chambers and dual exhaust outlets at the opposite vehicle sides between the front and rear wheels. Unfortunately, this prior art example does not enable a user to determine what type of sound is emitted from a vehicle exhaust system.

U.S. Pat. No. 6,202,409 to Taylor discloses an acoustical system with a sound-producing transducer mounted in the exhaust pipe of the engine, at proximity of the exhaust port and oriented toward the exhaust port, for emitting and directing a sound pulse toward the exhaust port. The sound-producing transducer is operable for bouncing a first sound pulse off the piston wall during the expansion cycle and immediately before opening the exhaust port, for creating a low pressure zone at the exhaust port and for enhancing the evacuation of exhaust gases from the combustion chamber. A second sound pulse is emitted at every compression cycle of the engine and directed at the exhaust port immediately before closing the exhaust port. The combination of the first and second sound pulses at every rotation of the engine provides an efficient scavenging and plugging of the engine for increasing the performance of the engine. Unfortunately, this prior art example does not enable a user to determine what type of sound is emitted from a vehicle exhaust system.

Accordingly, the present invention is disclosed in order to overcome the above noted shortcomings. The present invention satisfies such a need by providing a system that is convenient and easy to use, lightweight yet durable in design, and designed for allowing a user to generate a desired audible sound from an existing muffler exhaust system of the vehicle. The system is rust resistant, heat resistant, and allows a user to adapt a vehicle exhaust system to allow motorists to select the type of exhaust sound produced by a vehicle. The pipe that produces a relative quiet sound is advantageously used in restricted noise areas or residential areas and the loud exhaust pipe is used when the driver wants to produce a powerful resonating sound that sounds like a muscle car or an expensive sports car. The pipe selected and type of noise produced is determined by the switch position selected by the driver. The present invention is simple to use, inexpensive, and designed for many years of repeated use.

BRIEF SUMMARY OF THE INVENTION

In view of the foregoing background, it is therefore an object of the present invention to provide an apparatus for allowing a user to generate a desired audible sound from an existing muffler exhaust system of the vehicle. These and other objects, features, and advantages of the invention are provided by a dual-mode exhaust system.

A dual-mode exhaust system includes a housing with an input port attached to the existing muffler exhaust system and positioned downstream thereof. Such an housing further has first and second output ports in fluid communication with the input port. The system further includes a mechanism for selectively distributing vehicle exhaust from the input port to the first and second output ports such that the vehicle exhaust is effectively prohibited from simultaneously passing through the first and second output ports during operating conditions. Such a vehicle exhaust distributing mechanism includes a controller electrically mated to an existing vehicle power source and a motor provided with an annular toothed gear attached thereto. Such a motor and such a toothed gear are situated within the housing and rotate along clockwise and counter clockwise directions based upon a user input generated from the controller.

The vehicle exhaust distributing mechanism further includes upper and lower chambers vertically stacked within the housing. Such lower chambers are conveniently in fluid communication between the input port and the first and second output ports, and such an upper chamber is vertically displaced above the input port and the first and second output ports respectively. The lower chamber includes first and second gates juxtaposed adjacent to the first and second output ports. Such first and second gates are disposed upstream of the first and second output ports and further are located downstream of the input port.

The mechanism further includes first and second vertically spaced pendulum arms advantageously disposed within the upper and lower chambers respectively and anchored at respective distal ends thereof respectively. Such first and second arms maintain a fixed and static spatial relationship such that the first and second arms rotate in sync about a single fulcrum axis defined orthogonal to the distal ends respectively.

The first arm has a corrugated proximal edge directly interlocked with the toothed gear in such a manner that the first and second arms effectively articulate along counter clockwise and clockwise directions when the toothed gear rotates along clockwise and counter clockwise directions respectively. The first arm includes a plurality of stop members directly attached to longitudinal sides thereof. Such stop members terminate laterally of the longitudinal sides and are engageable with oppositely faced inner walls of the upper chamber to thereby prevent the first arm from traveling beyond predetermined threshold positions defined within the upper chamber.

The second arm is conveniently positioned between the first and second gates in such a manner that the second arm directly abuts against the first and second gates when the first arm is articulated to the threshold positions respectively. The second arm prohibits the vehicle exhaust from passing through the first and second gates when the second arm is abutted thereagainst respectively. The second arm has linear longitudinal sides extending parallel to a longitudinal length of the first and second gates to thereby provide a uniform seal therewith. The second arm further swings along an arcuate path defined between the first and second gates respectively.

The system further includes first and second vehicle exhaust pipes coupled to the first and second output ports in such a manner that first and second distinct audible sounds are advantageously generated from the existing vehicle muffler exhaust system when the vehicle exhaust exists from the first and second output ports respectively.

A method for generating a desired audible sound from an existing muffler exhaust system of the vehicle includes the steps of attaching an input port of a housing to the existing muffler exhaust system by positioning the housing downstream thereof. Such an housing has first and second output ports in fluid communication with the input port. The steps further include: coupling first and second vehicle exhaust pipes to the first and second output ports; selectively distributing vehicle exhaust from the input port to the first and second output ports such that the vehicle exhaust is prohibited from simultaneously passing through the first and second output ports during operating conditions; and generating first and second distinct audible sounds from the first and second exhaust pipes when the vehicle exhaust exists from the first and second output ports respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
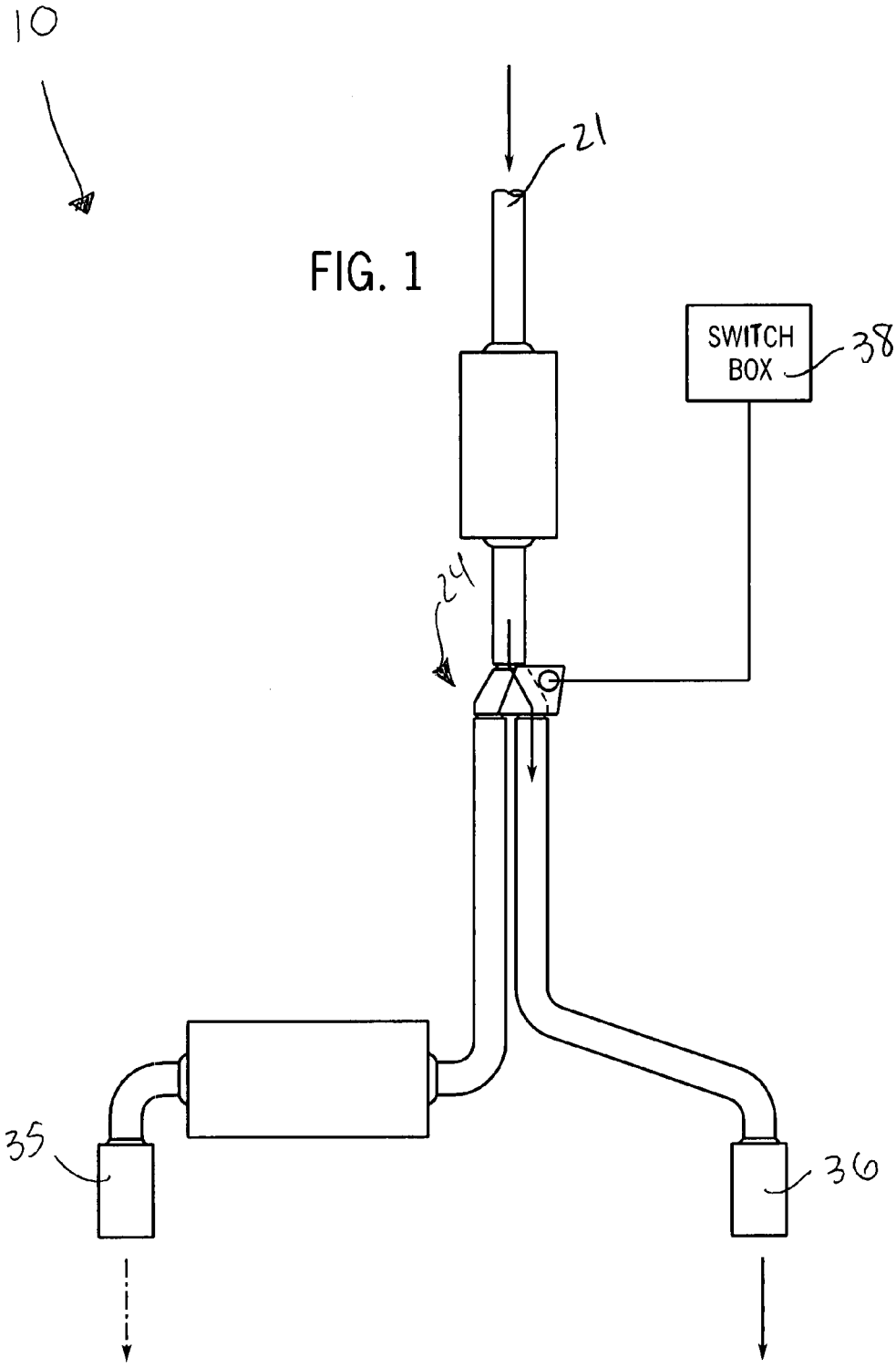
FIG. 1 is a top planar view of a dual mode exhaust system, in accordance with the present invention.
Figure 2:
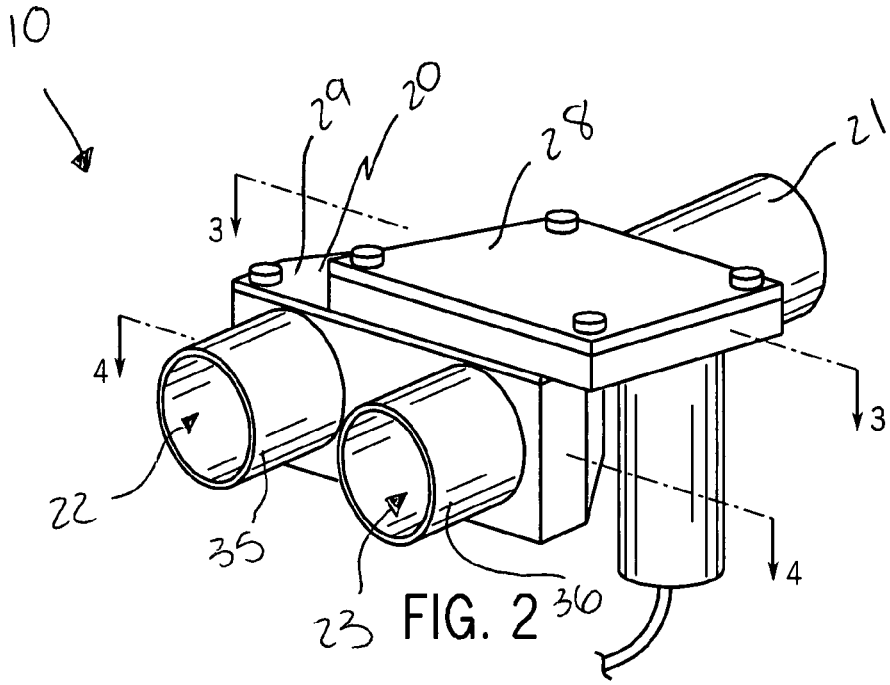
FIG. 2 is a perspective view of a dual mode exhaust system, in accordance with the present invention.
Figure 3:
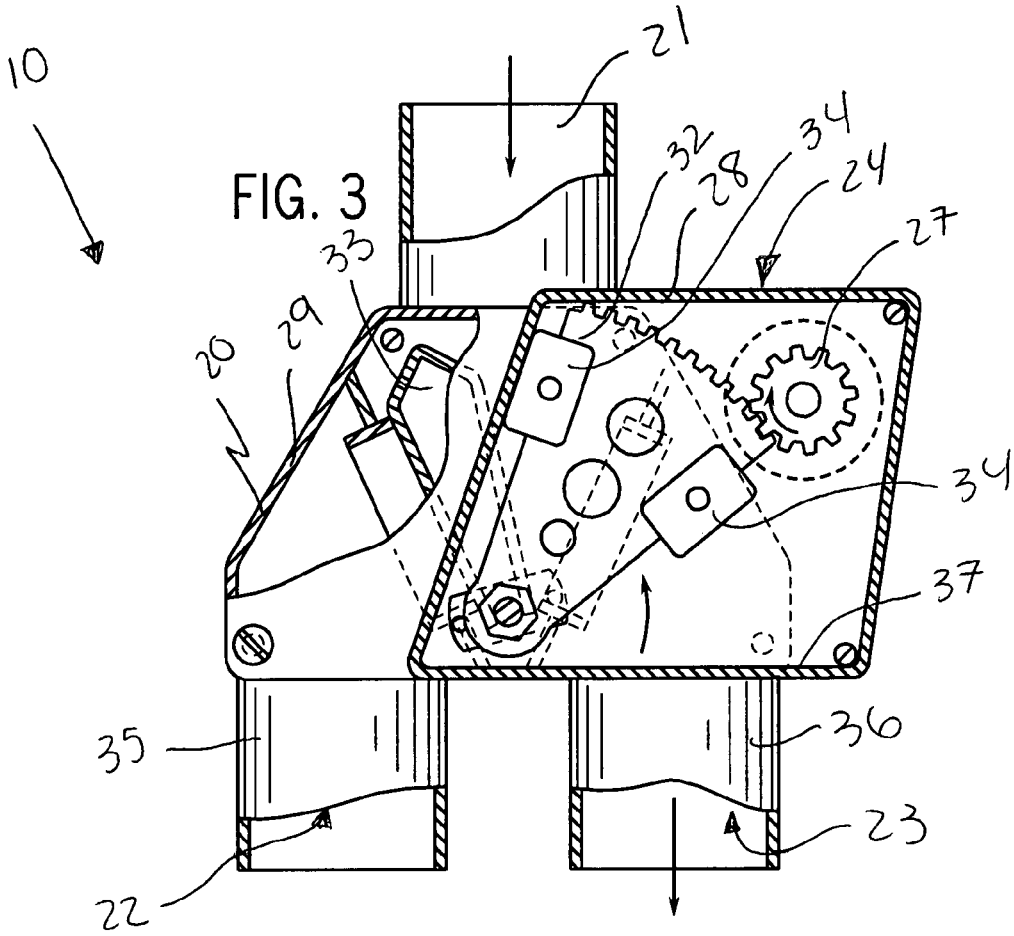
FIG. 3 is a cross sectional view, taken along line 3-3, as seen in FIG. 2.
Figure 4:
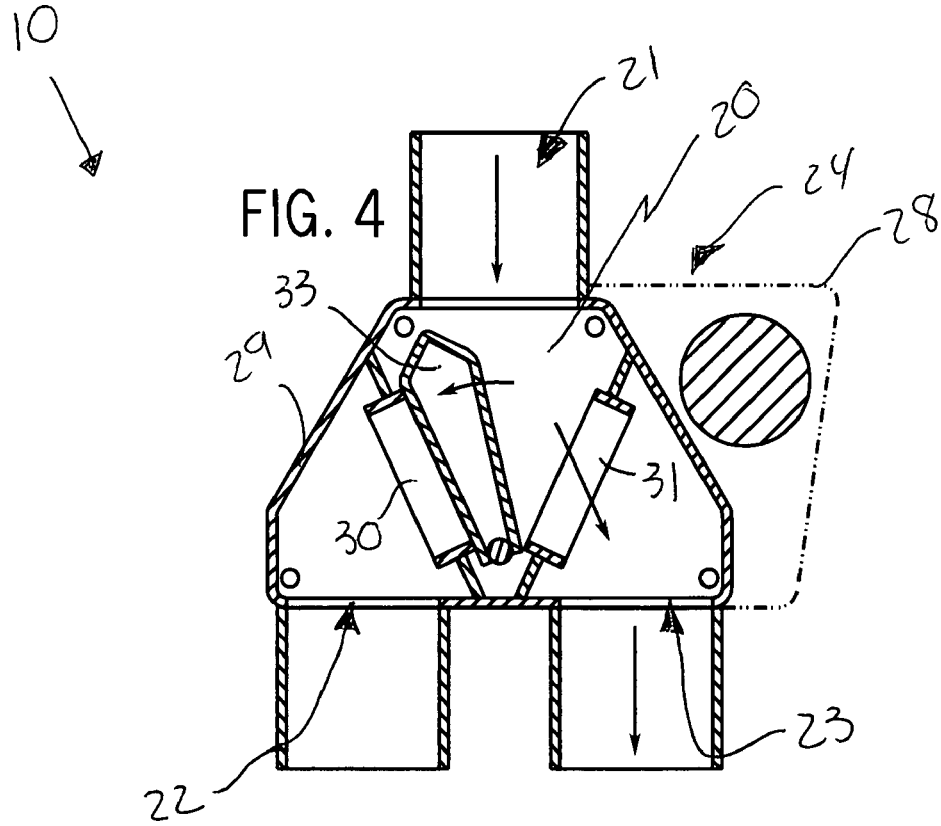
FIG. 4 is a cross sectional view, taken along line 4-4, as seen in FIG. 2, showing the second arm sealing the first gate, in accordance with the present invention.
Figure 5:
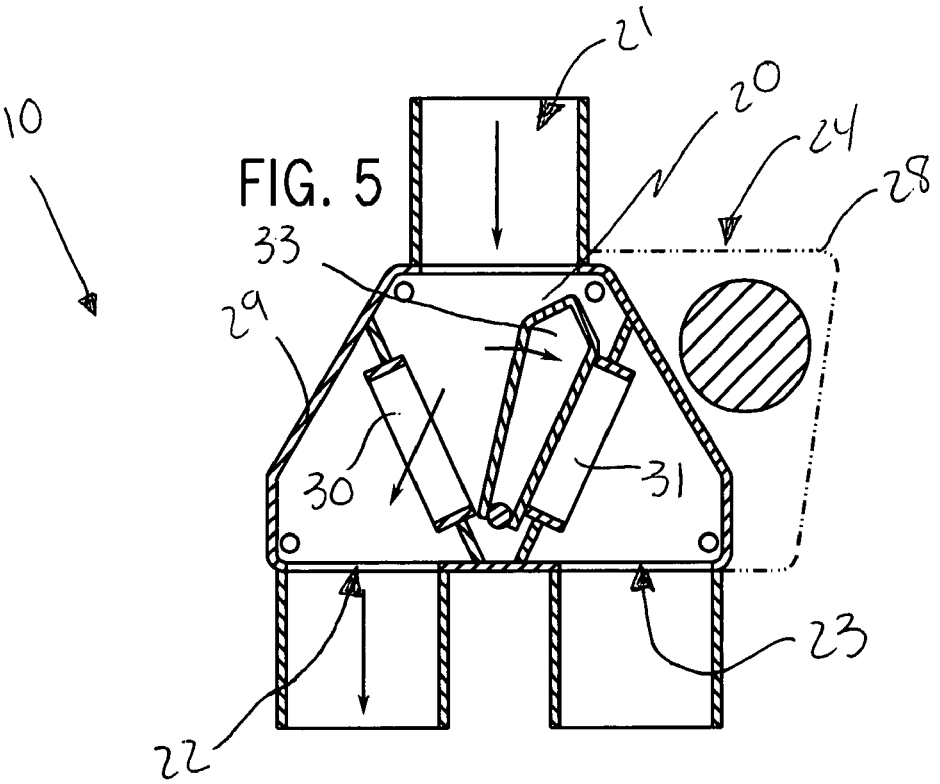
FIG. 5 is a cross sectional view, taken along line 4-4, as seen in FIG. 2, showing the second arm sealing the second gate, in accordance with the present invention.
Figure 6:
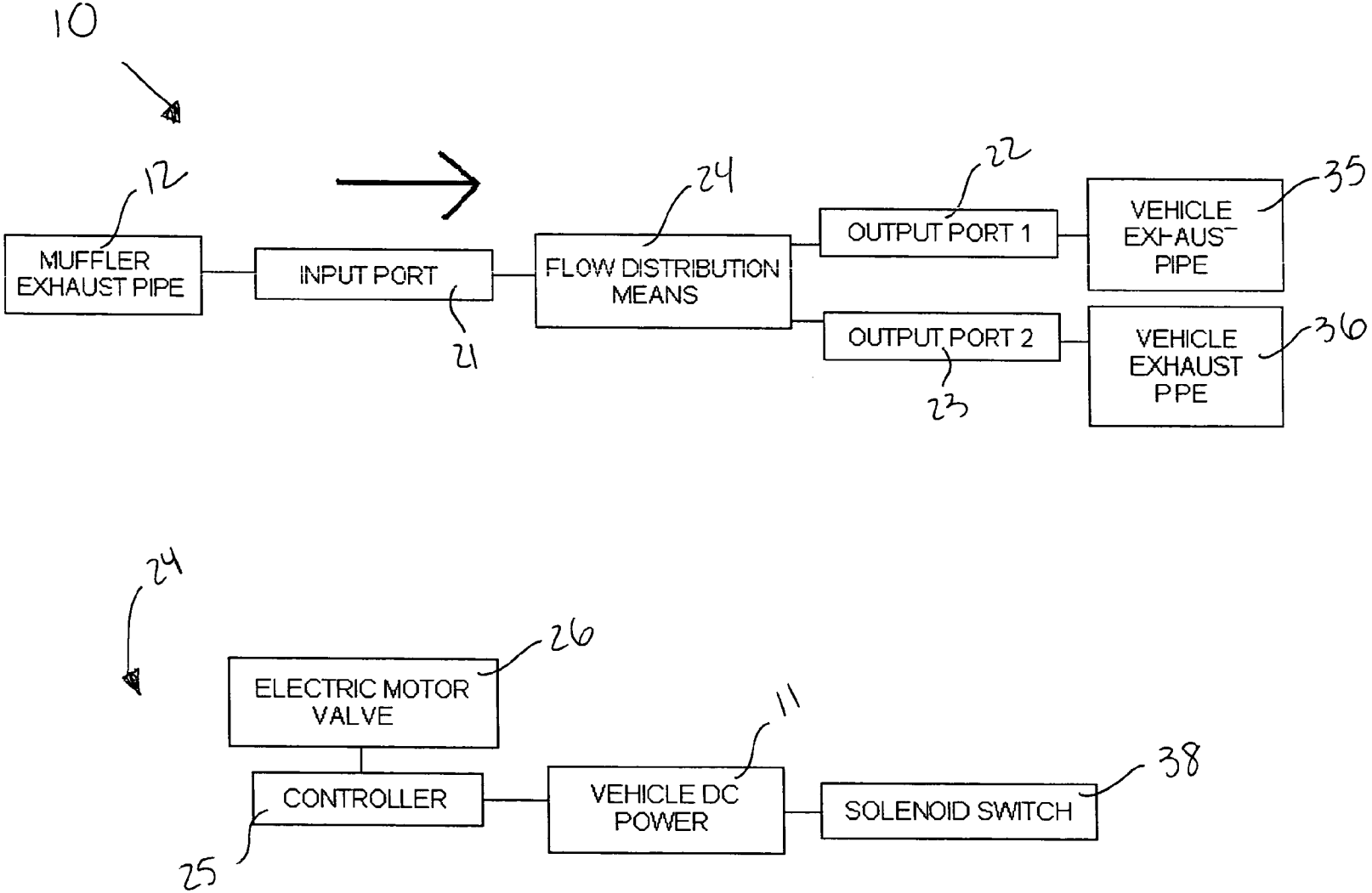
FIG. 6 is a schematic block diagram of the present invention.

The apparatus of this invention is referred to generally in FIGS. 1-6 by the reference numeral 10 and is intended to protect a dual-mode exhaust system. It should be understood that the apparatus 10 may be used with many different types of vehicles and should not be limited in use with only those vehicles mentioned herein.

Referring to FIGS. 1, 2, 3, 4, 5 and 6, a dual-mode exhaust system 10 includes a housing 20 with an input port 21 attached to the existing muffler exhaust system 12 and positioned downstream thereof. Such an housing 20 further has first and second output ports 22, 23 in fluid communication with the input port 21.

The system further includes a mechanism for selectively distributing vehicle exhaust from the input port 21 to the first and second output ports 22, 23 which is essential such that the vehicle exhaust is prohibited from simultaneously passing through the first and second output ports 22, 23 during operating conditions. Such a vehicle exhaust distributing mechanism 24 includes a controller 25 electrically mated to an existing vehicle power source 11 and a motor 26 provided with an annular toothed gear 27 attached thereto. Such a motor 26 and such a toothed gear 27 are situated within the housing 20 and rotate along clockwise and counter clockwise directions based upon a user input generated from the controller 25. The motor 26 and controller 25 are power by the existing vehicle power source 11 and are operated via a switch 38 located on the interior of an existing vehicle. The motor 26, as operated by the switch 38, will respectively move the toothed gear 27 in clockwise or counter clockwise directions, and thereby change the sound of the exhaust accordingly.

Referring again to FIGS. 1, 2, 3, 4, 5 and 6, the vehicle exhaust distributing mechanism 24 further includes upper and lower chambers 28, 29 vertically stacked within the housing 20. Such lower chambers 29 are in fluid communication between the input port 21 and the first and second output ports 22, 23, and such an upper chamber 28 is vertically displaced above the input port 21 and the first and second output ports 22, 23 respectively. The lower chamber 29 includes first and second gates 30, 31 juxtaposed adjacent to the first and second output ports 28, 29. Such first and second gates 30, 31 are disposed upstream of the first and second output ports 28, 29 and further are located downstream of the input port 21. The first and second gates 30, 31 operate in conjunction with the first and second output ports 22, 23, and according to which gate is open as enabled by the switch, a different sound will be emitted from the vehicle exhaust.

Referring again to FIGS. 1, 2, 3, 4, 5 and 6, the mechanism further 24 includes first and second vertically spaced pendulum arms 32, 33 disposed within the upper and lower chambers 28, 29 respectively and anchored at respective distal ends thereof respectively. Such first and second arms 32, 33 maintain a fixed and static spatial relationship which is important such that the first and second arms 32, 33 rotate in sync about a single fulcrum axis defined orthogonal to the distal ends respectively.

The first arm 32 has a corrugated proximal edge directly interlocked, without the use of intervening elements, with the toothed gear 27 in such a manner that the first and second arms 32, 33 articulate along counter clockwise and clockwise directions when the toothed gear 27 rotates along clockwise and counter clockwise directions respectively. The first arm 32 includes a plurality of stop members 34 directly attached, without the use of intervening elements, to longitudinal sides thereof. Such stop members 34 terminate laterally of the longitudinal sides and are engageable with oppositely faced inner walls 37 of the upper chamber 28 to thereby prevent the first arm 32 from traveling beyond predetermined threshold positions defined within the upper chamber 28.

The second arm 33 is positioned between the first and second gates 30, 31 in such a manner that the second arm 33 directly abuts, without the use of intervening elements, against the first and second gates 30, 31 when the first arm 32 is articulated to the threshold positions respectively. The second arm 33 prohibits the vehicle exhaust from passing through the first and second gates 30, 31 when the second arm 33 is abutted thereagainst respectively. The second arm 33 has linear longitudinal sides extending parallel to a longitudinal length of the first and second gates 30, 31 to thereby provide a uniform seal therewith. The second arm 33 further swings along an arcuate path defined between the first and second gates 30, 31 respectively. The first and second arms are used to seal either a first or second gate and thereby ensure that only one gate is open and only one sound will be emitted from a vehicle exhaust, depending on which gate remains unsealed.

Referring again to FIGS. 1, 2, 3, 4, 5 and 6, the system further includes first and second vehicle exhaust pipes 35, 36 coupled to the first and second output ports 22, 23 in such a manner that first and second distinct audible sounds are generated from the existing vehicle muffler exhaust system when the vehicle exhaust exists from the first and second output ports 22, 23 respectively. The first and second vehicle pipes enable a clearly audible sound to be emitted from the system.

The present invention, as claimed, provides the unexpected and unpredictable benefit of enabling a user the ability to choose alternate sounds to be emitted from a vehicle exhaust system. The first and second output ports 22, 23 provide the unexpected benefit of allowing two different sounds to be emitted from the same system. The switch 38 ensures that a user never manually handles parts, but rather flips a switch 38 in order to change the type of sound emitted from the exhaust system. Such benefits overcome the prior art shortcomings.

In use, a method for generating a desired audible sound from an existing muffler exhaust system of the vehicle includes the steps of attaching an input port 21 of a housing 20 to the existing muffler exhaust system by positioning the housing 20 downstream thereof. Such an housing 20 has first and second output ports 22, 23 in fluid communication with the input port 21. The steps further include: coupling first and second vehicle exhaust pipes 35, 36 to the first and second output ports 22, 23; selectively distributing vehicle exhaust from the input port 21 to the first and second output ports 22, 23 such that the vehicle exhaust is prohibited from simultaneously passing through the first and second output ports 22, 23 during operating conditions; and generating first and second distinct audible sounds from the first and second exhaust pipes 35, 36 when the vehicle exhaust exists from the first and second output ports 22, 23 respectively.

The flow distribution mechanism 24 is installed to a pre-existing vehicle exhaust system's muffler via the input port 21. The output ports 22, 23 are coupled to the first and second vehicle exhaust pipes 35, 36 via custom installation. The motor 26 of the flow distribution mechanism 24 runs the system 10, and the motor 26 may be operated by a user via a switch 38 that is installed on the interior dashboard of a vehicle. A flip of the switch 38 enables a user to choose which output port they want to use.

Upon activation of the switch 38 by a user, the first and second arms 32, 33 move simultaneously to close either the first or second gate 30, 31, according to which sound output a user wishes to activate. When one output sound is chosen by a user, via the switch 38, the arms 32, 33 move to block one gate so that only one sound will be emitted through the other gate and output port. By flipping the switch 38, a user may easily alternate from a standard exhaust system to a sports exhaust system, even while the engine is running and the vehicle is moving.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A dual-mode exhaust system for allowing a user to generate a desired audible sound from an existing muffler exhaust system of a vehicle, said dual-mode exhaust system comprising:

a housing having an input port attached to the existing muffler exhaust system, said housing further having first and second output ports in fluid communication with said input port;

means for selectively distributing vehicle exhaust from said input port to said first and second output ports such that the vehicle exhaust is prohibited from simultaneously passing through said first and second output ports during operating conditions; and first and second vehicle exhaust pipes coupled to said first and second output ports in such a manner that first and second distinct audible sounds are generated from the existing vehicle muffler exhaust system when the vehicle exhaust exits from said first and second output ports respectively;

wherein said vehicle exhaust distributing means comprises:

a controller electrically mated to an existing vehicle power source;

a motor provided with an annular toothed gear attached thereto, said motor and said toothed gear being situated within said housing and rotating along clockwise and counter clockwise directions based upon a user input generated from said controller;

upper and lower chambers vertically stacked within said housing, said lower chambers being in fluid communication between said input port and said first and second output ports, said upper chamber being vertically displaced above said input port and said first and second output ports respectively;

first and second vertically spaced pendulum arms disposed within said upper and lower chambers respectively and anchored at respective distal ends thereof respectively, said first and second arms maintaining a fixed and static spatial relationship such that said first and second arms rotate in sync about a single fulcrum axis defined orthogonal to said distal ends respectively; and said first arm having a corrugated proximal edge directly interlocked with said toothed gear in such a manner that said first and second arms articulate along counter clockwise and clockwise directions when said toothed gear rotates along clockwise and counter clockwise directions respectively.

2. The dual-mode exhaust system of claim 1, wherein said first arm comprises:

a plurality of stop members directly attached to longitudinal sides thereof, said stop members terminating laterally of said longitudinal sides and being engageable with oppositely faced inner walls of said upper chamber to thereby prevent said first arm from traveling beyond predetermined threshold positions defined within said upper chamber.

3. The dual-mode exhaust system of claim 1, wherein said lower chamber comprises:

first and second gates juxtaposed adjacent to said first and second output ports, said first and second gates being disposed upstream of said first and second output ports and further being located downstream of said input port;

wherein said second arm is positioned between said first and second gates in such a manner that said second arm directly abuts against said first and second gates when said first arm is articulated to said threshold positions respectively, said second arm prohibiting the vehicle exhaust from passing through said first and second gates when said second arm is abutted thereagainst respectively.

4. The dual-mode exhaust system of claim 3, wherein said second arm has linear longitudinal sides extending parallel to a longitudinal length of said first and second gates to thereby provide a uniform seal therewith.

5. The dual-mode exhaust system of claim 3, wherein said second arm swings along an arcuate path defined between said first and second gates respectively.

6. A dual-mode exhaust system for allowing a user to generate a desired audible sound from an existing muffler exhaust system of a vehicle, said dual-mode exhaust system comprising:

a housing having an input port attached to the existing muffler exhaust system and positioned downstream thereof, said housing further having first and second output ports in fluid communication with said input port;

means for selectively distributing vehicle exhaust from said input port to said first and second output ports such that the vehicle exhaust is prohibited from simultaneously passing through said first and second output ports during operating conditions; and first and second vehicle exhaust pipes coupled to said first and second output ports in such a manner that first and second distinct audible sounds are generated from the existing vehicle muffler exhaust system when the vehicle exhaust exits from said first and second output ports respectively;

wherein said vehicle exhaust distributing means comprises:

a controller electrically mated to an existing vehicle power source;

a motor provided with an annular toothed gear attached thereto, said motor and said toothed gear being situated within said housing and rotating along clockwise and counter clockwise directions based upon a user input generated from said controller;

upper and lower chambers vertically stacked within said housing, said lower chambers being in fluid communication between said input port and said first and second output ports, said upper chamber being vertically displaced above said input port and said first and second output ports respectively;

first and second vertically spaced pendulum arms disposed within said upper and lower chambers respectively and anchored at respective distal ends thereof respectively, said first and second arms maintaining a fixed and static spatial relationship such that said first and second arms rotate in sync about a single fulcrum axis defined orthogonal to said distal ends respectively; and said first arm having a corrugated proximal edge directly interlocked with said toothed gear in such a manner that said first and second arms articulate along counter clockwise and clockwise directions when said toothed gear rotates along clockwise and counter clockwise directions respectively.

7. The dual-mode exhaust system of claim 6, wherein said first arm comprises:

a plurality of stop members directly attached to longitudinal sides thereof, said stop members terminating laterally of said longitudinal sides and being engageable with oppositely faced inner walls of said upper chamber to thereby prevent said first arm from traveling beyond predetermined threshold positions defined within said upper chamber.

8. The dual-mode exhaust system of claim 6, wherein said lower chamber comprises:

first and second gates juxtaposed adjacent to said first and second output ports, said first and second gates being disposed upstream of said first and second output ports and further being located downstream of said input port;

wherein said second arm is positioned between said first and second gates in such a manner that said second arm directly abuts against said first and second gates when said first arm is articulated to said threshold positions respectively, said second arm prohibiting the vehicle exhaust from passing through said first and second gates when said second arm is abutted thereagainst respectively.

9. The dual-mode exhaust system of claim 8, wherein said second arm has linear longitudinal sides extending parallel to a longitudinal length of said first and second gates to thereby provide a uniform seal therewith.

10. The dual-mode exhaust system of claim 8, wherein said second arm swings along an arcuate path defined between said first and second gates respectively.

11. A method for generating a desired audible sound from an existing muffler exhaust system of a vehicle, said method comprising the steps of:

a. attaching an input port of a housing to the existing muffler exhaust system by positioning said housing downstream thereof, said housing having first and second output ports in fluid communication with said input port;

b. coupling first and second vehicle exhaust pipes to said first and second output ports;

c. selectively distributing vehicle exhaust from said input port to said first and second output ports such that the vehicle exhaust is prohibited from simultaneously passing through said first and second output ports during operating conditions; and d. generating first and second distinct audible sounds from the first and second exhaust pipes when the vehicle exhaust exits from said first and second output ports respectively;

wherein said vehicle exhaust distributing means comprises:

a controller electrically mated to an existing vehicle power source;

a motor provided with an annular toothed gear attached thereto, said motor and said toothed gear being situated within said housing and rotating along clockwise and counter clockwise directions based upon a user input generated from said controller;

upper and lower chambers vertically stacked within said housing, said lower chambers being in fluid communication between said input port and said first and second output ports, said upper chamber being vertically displaced above said input port and said first and second output ports respectively;

first and second vertically spaced pendulum arms disposed within said upper and lower chambers respectively and anchored at respective distal ends thereof respectively, said first and second arms maintaining a fixed and static spatial relationship such that said first and second arms rotate in sync about a single fulcrum axis defined orthogonal to said distal ends respectively; and said first arm having a corrugated proximal edge directly interlocked with said toothed gear in such a manner that said first and second arms articulate along counter clockwise and clockwise directions when said toothed gear rotates along clockwise and counter clockwise directions respectively.

12. The method of claim 11, wherein said first arm comprises:

a plurality of stop members directly attached to longitudinal sides thereof, said stop members terminating laterally of said longitudinal sides and being engageable with oppositely faced inner walls of said upper chamber to thereby prevent said first arm from traveling beyond predetermined threshold positions defined within said upper chamber.

13. The method of claim 11, wherein said lower chamber comprises:

first and second gates juxtaposed adjacent to said first and second output ports, said first and second gates being disposed upstream of said first and second output ports and further being located downstream of said input port;

wherein said second arm is positioned between said first and second gates in such a manner that said second arm directly abuts against said first and second gates when said first arm is articulated to said threshold positions respectively, said second arm prohibiting the vehicle exhaust from passing through said first and second gates when said second arm is abutted thereagainst respectively.

14. The method of claim 13, wherein said second arm has linear longitudinal sides extending parallel to a longitudinal length of said first and second gates to thereby provide a uniform seal therewith.

15. The method of claim 13, wherein said second arm swings along an arcuate path defined between said first and second gates respectively.

* * * * *